US010208411B2

(12) United States Patent
Ichikawa

(10) Patent No.: US 10,208,411 B2
(45) Date of Patent: Feb. 19, 2019

(54) THREAD FEEDING DEVICE FOR TORCHON LACE MACHINE

(71) Applicant: ICHIKAWA IRON WORKS CO., LTD., Kiryu-shi, Gunma (JP)

(72) Inventor: Michihiro Ichikawa, Kiryu (JP)

(73) Assignee: ICHIKAWA IRON WORKS CO., LTD., Kiryu-shi (JP)

( * ) Notice: Subject to any disclaimer, the term of this patent is extended or adjusted under 35 U.S.C. 154(b) by 340 days.

(21) Appl. No.: 15/028,795

(22) PCT Filed: Oct. 14, 2014

(86) PCT No.: PCT/JP2014/005202
§ 371 (c)(1),
(2) Date: Apr. 12, 2016

(87) PCT Pub. No.: WO2015/056441
PCT Pub. Date: Apr. 23, 2015

(65) Prior Publication Data

US 2016/0251786 A1 Sep. 1, 2016

(30) Foreign Application Priority Data

Oct. 18, 2013 (JP) ..... 2013-217591

(51) Int. Cl.
*D04C 3/18* (2006.01)

(52) U.S. Cl.
CPC ..... *D04C 3/18* (2013.01)

(58) Field of Classification Search
CPC ..... D04C 3/18
See application file for complete search history.

(56) References Cited

U.S. PATENT DOCUMENTS 694,536 A * 3/1902 Diss ..... D04C 3/14 87/22
3,396,625 A * 8/1968 Faulkner ..... D04C 3/18 87/22

(Continued)

FOREIGN PATENT DOCUMENTS

JP S52-70159 A 6/1977
JP 2008-248458 A 10/2008

OTHER PUBLICATIONS

Jan. 20, 2015 Search Report issued in International Patent Application No. PCT/JP2014/005202.

(Continued)

*Primary Examiner* — Shaun R Hurley
(74) *Attorney, Agent, or Firm* — Oliff PLC

(57) ABSTRACT

A thread feeding device for the torchon lace machine includes a spindle provided to stand at a runner moving along an orbit due to rotation of rotor metals, and a standing member including a thread feeding hole to pull out a carbon thread wound around a bobbin rotatably inserted into the spindle and a bobbin stopper. The carbon thread is set to form a U-shape among rollers each with thread guide which are respectively provided at a base end side and a tip end side of a head member of the standing member and a roller with thread guide which is provided at a slide body provided to be vertically slidable at a lower side than the head member to enable to feed to the knitting part.

5 Claims, 5 Drawing Sheets

(56) References Cited

U.S. PATENT DOCUMENTS

| | | | | | |
|---|---|---|---|---|---|
| 3,839,939 | A * | 10/1974 | Wily | B65H 59/04 | 87/21 |
| 4,719,838 | A * | 1/1988 | DeYoung | D03C 3/18 | 87/21 |
| 4,788,898 | A * | 12/1988 | Bull | D04C 3/18 | 242/156.2 |
| 5,146,836 | A * | 9/1992 | DeYoung | D04C 3/18 | 87/22 |
| 5,974,938 | A * | 11/1999 | Lloyd | D04C 3/14 | 87/44 |
| 7,093,527 | B2 * | 8/2006 | Rapaport | A61F 2/90 | 87/34 |
| 7,134,376 | B1 * | 11/2006 | Chen | D04C 3/18 | 87/55 |
| 2003/0141101 | A1 * | 7/2003 | Mima | H01B 5/12 | 174/128.1 |
| 2004/0173087 | A1 * | 9/2004 | Chen | D04C 3/18 | 87/55 |
| 2004/0254633 | A1 * | 12/2004 | Rapaport | A61F 2/90 | 623/1.15 |
| 2012/0144984 | A1 | 6/2012 | Head, III et al. | | |
| 2015/0375447 | A1 * | 12/2015 | Tahara | B29C 70/32 | 156/443 |

OTHER PUBLICATIONS

Jul. 14, 2017 Search Report issued in European Patent Application No. 14853334.2.

* cited by examiner

THREAD FEEDING DEVICE FOR TORCHON LACE MACHINE

CROSS-REFERENCE TO RELATED APPLICATION

This application is a U.S. National Stage application claiming the benefit of prior filed International Application Number PCT/JP2014/005202, filed Oct. 14, 2014, in which the International Application claims the priority from Japanese Patent Application No. 2013-217591, filed Oct. 18, 2013, the entire contents of which are incorporated herein by reference.

TECHNICAL FIELD

The present invention relates to a thread feeding device for a torchon lace machine which enables a carbon thread made up by bundling single fibers (thickness: 5 μm to 7 μm) of a number of carbon fibers to be smoothly fed to a knitting part without causing cutting-off (fluffing) of a piece of single fiber.

BACKGROUND ART

A conventional torchon lace machine is disclosed in, for example, Japanese Unexamined Patent Application Publication No. 2008-248458 (FIG. 5). In the conventional machine, it is constituted such that a thread 53 wound around a bobbin 52 fitted into a hollow spindle 51 is pulled out of a thread feeding hole 54' of a standing member (yarn guide) 54, and after it is passed through a thread feeding hole 55' of a bobbin stopper 55 provided at an upper part of the standing member 54, it is fed from a thread feeding hole 58 at an upper end of the hollow spindle 51 to a knitting part (not-illustrated) through a hook 57" at an upper end of a wire 57' extended from a spring 57 whose base end is connected to a stop ring 56 at an inner part of the hollow spindle 51, as illustrated in FIG. 5.

PATENT DOCUMENT

Patent Document 1: Japanese Unexamined Patent Application Publication No. 2008-248458

DISCLOSURE OF THE INVENTION

Problems to be Solved

However, the carbon thread made up by bundling the single fibers (thickness: 5 μm to 7 μm) of a number of carbon fibers exhibits an extremely high strength in a tensile direction, but it is weak for folding and friction. The carbon thread is passed through "thread feeding holes" provided at a plurality of positions until it is fed to the knitting part, and therefore, the friction becomes large, and the carbon thread is not only fluffed but also there is a possibility in which one piece to a plurality pieces of single fibers of the bundled carbon thread are cut-off, though it is necessary to feed the carbon thread to the knitting part without causing cutting-off of one piece of single fiber.

Means for Solving the Problems

The present invention is made to solve the above-stated problems, and a proposition thereof is to provide a thread feeding device for a torchon lace machine capable of feeding a carbon thread to a knitting part without causing fluffing.

To attain the above-stated proposition, the present invention is characterized in that a spindle which is provided to stand at a runner moving along an orbit due to rotation of rotor metals; and a standing member which includes a thread feeding hole to pull out a carbon thread wound around a bobbin rotatably inserted into the spindle and a bobbin stopper are included, wherein a U-shape is formed among rollers each with thread guide which are respectively provided at a base end side and a tip end side of a head member of the standing member and a roller with thread guide which is provided at a slide body provided to be vertically slidable at a lower part than the head member, to enable to feed the carbon thread to a knitting part. It is constituted such that the carbon thread is able to be smoothly fed to the knitting part without any friction.

The invention as described above, in embodiments, is further characterized in that the roller with thread guide provided at the tip end side of the head member is provided at an upper surface of a disc rotatably provided in a horizontal direction. It is constituted such that the roller with thread guide which feeds the carbon thread to the knitting part constantly positions correctly relative to the knitting part even when the runner moves right or left along the orbit due to the rotation of the rotor metals.

Further, the invention as described above, in embodiments, is characterized in that the slide body is tied up by a wire being extended from an upper end of a coil spring whose base end is coupled to a stop ring which is fitted to a lower part of the spindle and having a push-up part of the bobbin stopper in a middle thereof. It is constituted such that tension of the thread can be kept constant even when the bobbin transfers from inside to outside, or outside to inside of the orbit due to the rotation of the rotor metals.

Further, the invention as described above, in embodiments, is characterized in that a line of the carbon thread which enters the roller at the upper surface of the disc of the head member from the roller of the slide body is on a center line of the runner or in a vicinity thereof. It is constituted such that a path where a reed knife passes through is enough secured even when a wide product is effectively created by increasing the number of bobbins compared to a normal torchon lace machine.

Effects

According to the present invention, a spindle provided to stand on a runner moving along an orbit due to rotation of rotor metals; and a standing member including a thread feeding hole to pull out a carbon thread wound around a bobbin rotatably inserted into the spindle and a bobbin stopper are included, wherein U-shape is formed among rollers each with thread guide which are respectively provided at a base end side and a tip end side of a head member of the standing member and a roller with thread guide which is provided at a slide body provided to be vertically slidable at a lower side than the head member to feed to a knitting part. Namely, the carbon thread is once stored in U-shape, then the stored part is able to be smoothly fed to the knitting part under a flat state without being excessively tightened up. When a pulley whose cross sectional shape is V-shape is used to feed to the knitting part, a peripheral velocity difference is generated between inside/outside layers of the carbon thread, and the inside layer is loosen, then the single fiber is entangled in a groove part (V bottom) of the pulley, is cut-off and fluffed, and it takes time to remove the single fiber entangled in the groove part. Therefore, various excellent effects such that there are no problems as stated above are obtained by not using the pulley whose cross sectional shape is V-shape.

Besides, according to the invention described above, there is an excellent effect in which a feeding point of the carbon thread constantly positions correctly relative to the knitting part even when transferring of the runner moves right or left along the orbit due to the rotation of the rotor metals, and therefore, it is possible to perform the smooth feeding because the roller with thread guide at the tip end side of the head member is provided at the upper surface of the disc rotatably provided in the horizontal direction.

Further, according to the invention described above, it is possible to constantly keep the tension of the thread when the bobbin transfers from inside to outside, or outside to inside of the orbit due to the rotation of the rotor metals because the slide body is tied up by the wire being extended from the upper end of the coil spring whose base end is coupled to the stop ring which is fitted into the lower part of the spindle, and having the push-up part of the bobbin stopper in the middle thereof. Besides, when a storage amount of the carbon thread which is stored in the U-shape becomes small when it is fed to the knitting part, the slide body goes up to release the bobbin stopper, and the U-shape is formed in accordance with lowering of the slide body to prepare for the next feeding. Further, there is an excellent effect in which the stop ring falls down to immediately stop the machine when the carbon thread is cut-off.

Furthermore, according to the invention described above, there is an excellent effect such that it is possible to surely secure the path where the reed knife (not-illustrated) passes through and the carbon thread is not damaged by the reed knife even when the wide product is effectively created by increasing the number of bobbins compared to the normal torchon lace machine, because the line of the carbon thread which enters the roller at the upper surface of the disc of the head member from the roller of the slide body is on the center line of the runner or in a vicinity thereof.

DETAILED DESCRIPTION OF THE EMBODIMENTS

Figure 1:
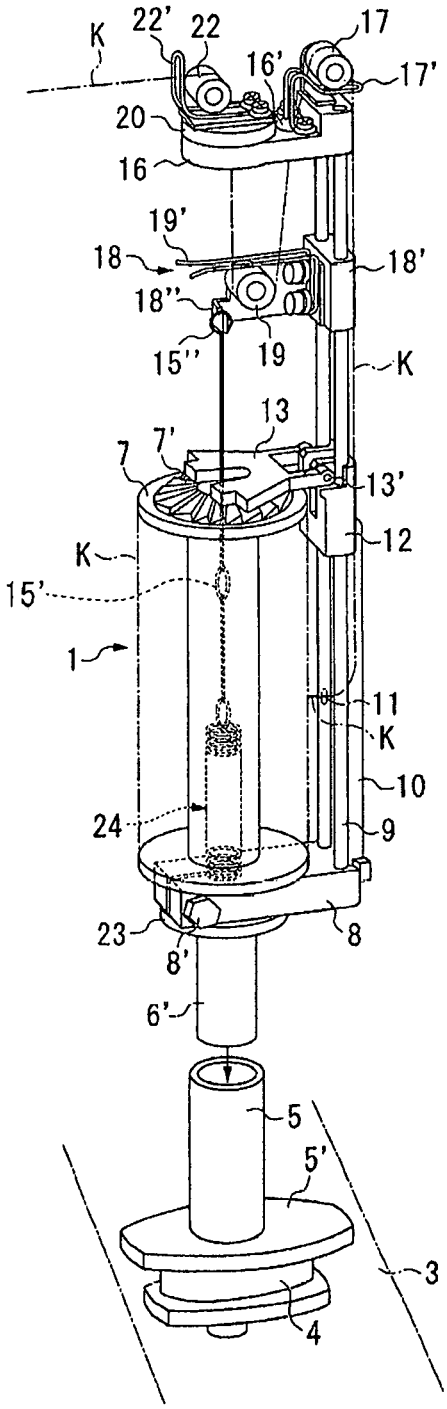
FIG. 1 is a perspective view of a thread feeding device according to the present invention.
Figure 2:
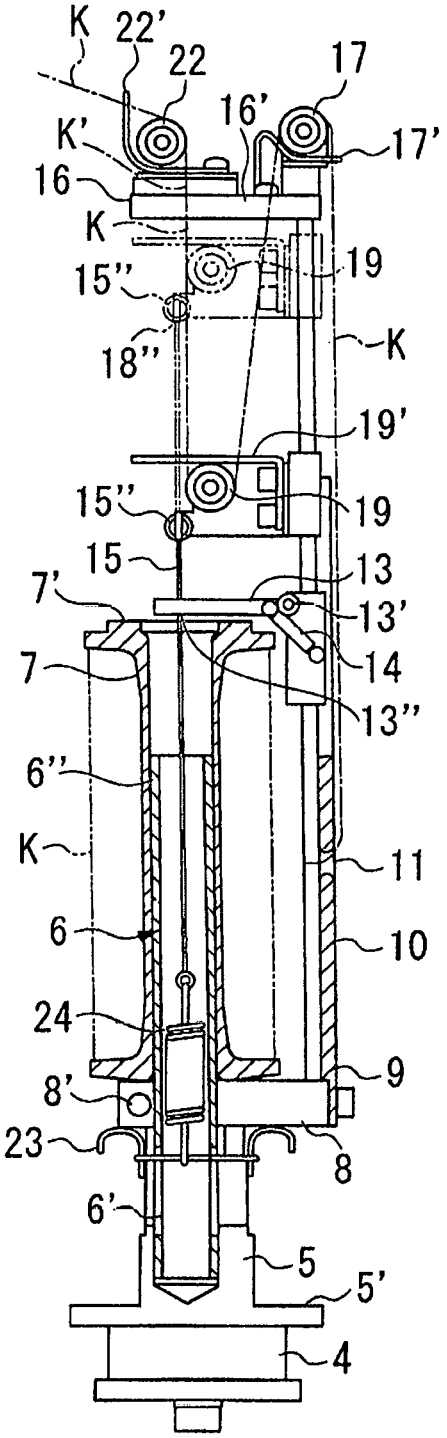
FIG. 2 is a side view illustrating a vertical slide position of a slide body of the thread feeding device according to the present invention.
Figure 3:
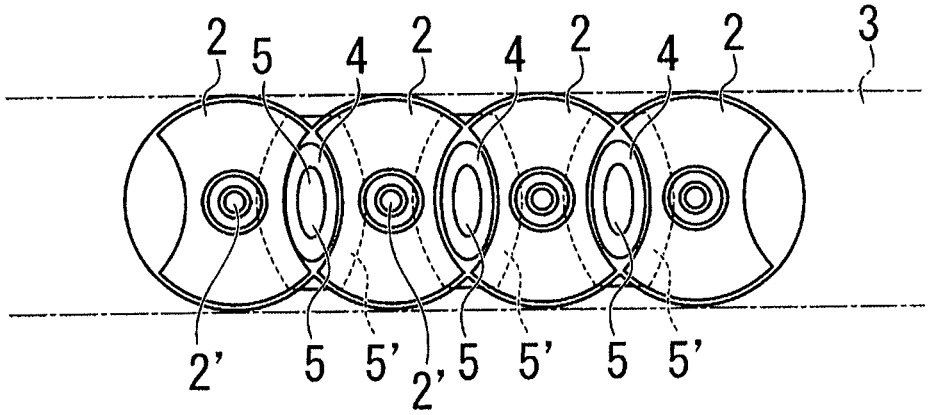
FIG. 3 is a partial plan view illustrating a disposition of rotor metals and a runner.
Figure 4:
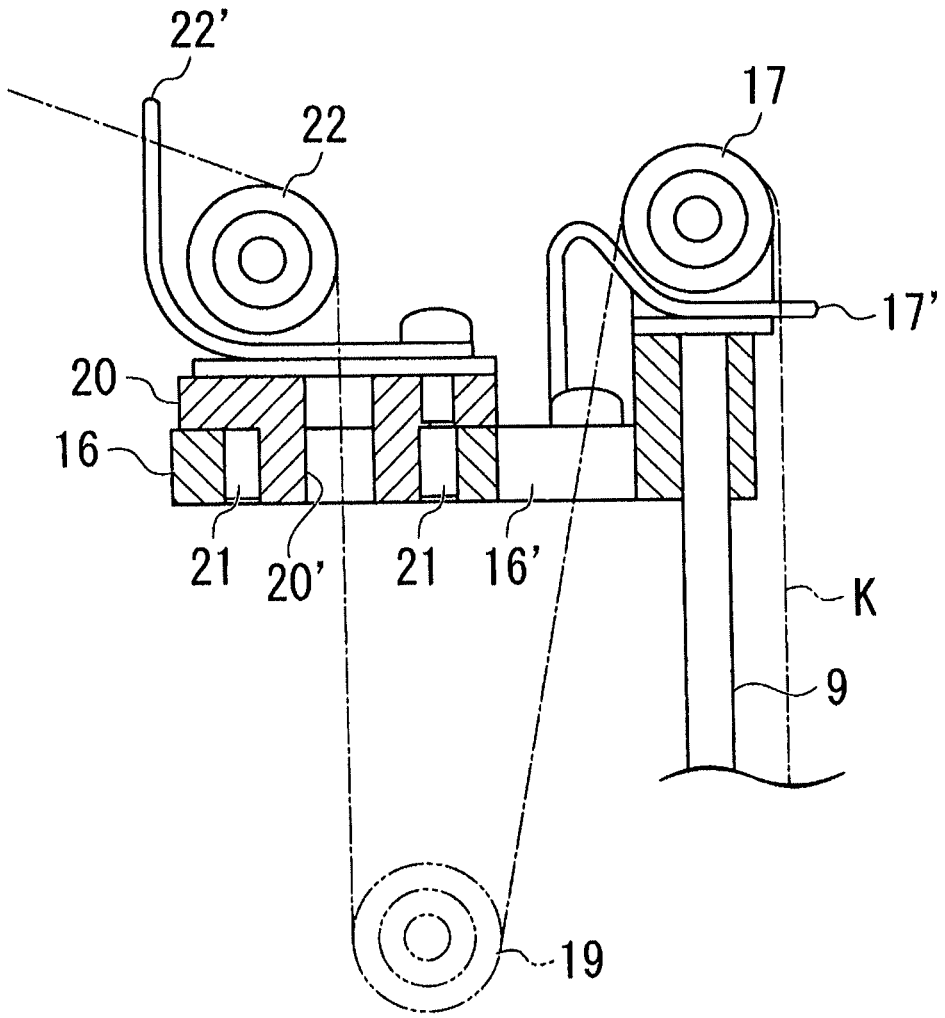
FIG. 4 is a sectional view illustrating two rollers each with thread guide provided at a head member of a standing member.
Figure 5:
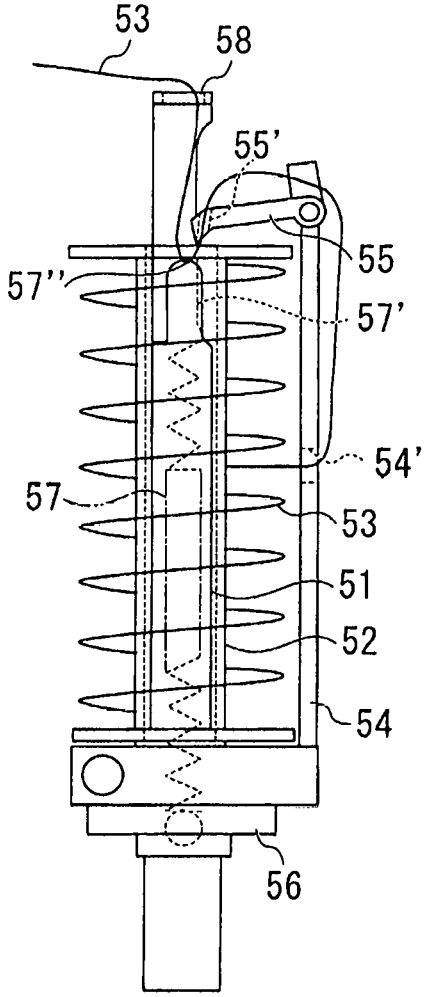
Fig.5 Prior Art
FIG. 5 is a front view of a conventional thread feeding device.

Next, an embodiment of the present invention is described based on the attached drawings. FIG. 1 is a perspective view of a thread feeding device according to the present invention, FIG. 2 is a side view illustrating a vertical slide position of a slide body of the thread feeding device according to the present invention, FIG. 3 is a partial plan view illustrating a disposition of rotor metals and a runner, and FIG. 4 is a sectional view illustrating two rollers each with thread guide provided at a head body of a standing member.

In FIG. 1, a reference numeral 1 is a thread feeding device of the present invention. As illustrated in FIG. 3, the thread feeding device 1 of the present invention is set at a center position of a runner 4 held between right and left recessed parts of rotor metals (each having recessed parts with the same diameter at right and left parts of a circle) 2 arranged along an orbit 3. The runner 4 is transferred to right or left along the orbit 3 due to rotation of the rotor metals 2, and therefore, the thread feeding device 1 of the present invention which is set at the runner 4 is simultaneously transferred.

A lower part 6' of the spindle 6 is coupled to a spindle holder 5 provided at a center of the runner 4. A flange part 5' of the spindle holder 5 is not a circle (an oval), and rotation thereof is restricted by being hit against a rotation axis 2' of the rotor metal 2. The spindle 6 is hollow (cylindrical state), short and small. A center hole of a bobbin 7 is rotatably inserted into an upper part 6" of the spindle 6.

A frame member 8 is fixed at a boundary part between the lower part 6' and the upper part 6" of the spindle 6 by fastening a screw 8'. A standing member 9 made up of two shafts is stood up along the spindle 6 at an outer end part of the frame member 8. A guide plate 10 is integrally attached at an outer side of the standing member 9. A thread feeding hole 11 to pull out a carbon thread K wound around the bobbin 7 is provided at the guide plate 10. A part of the thread feeding hole 11 where the carbon thread K is in contact is finished to be smooth.

An actiniform cog 7' is engraved in a ring state at a periphery of the center hole at an upper surface of the bobbin 7. A bobbin stopper 13 is pivotally supported by an intermediate member 12 which is fixed at an intermediate part of the standing member 9 to be able to rotate centering on a pin 13' at the actiniform cog 7'. The bobbin stopper 13 is engaged with the actiniform cog 7' via a lower surface projection 13" (refer to FIG. 2).

The bobbin stopper 13 is normally pulled by a spring 14. Therefore, the bobbin stopper 13 rotates downward centering on the pin 13' to engage the lower surface projection 13" with the actiniform cog 7'. On the other hand, as for upward mobility thereof, it is pushed up by an enlarged part 15' when a later-described wire 15 moves upward, releases the lower surface projection 13" from the actiniform cog 7' to enable the bobbin 7 rotate freely.

The bobbin stopper 13 is able to keep a standing state owing to a function of the spring 14 by pinching the bobbin stopper 13 with fingers to turn upward and raise centering on the pin 13'. This is performed when the bobbin 7 is pulled out from an upper end of the spindle 6. In other words, it enables to easily exchange the bobbin 7 with a new bobbin when the wound carbon thread is exhausted. As stated above, the spindle 6 is made small and short for this reason.

A head member 16 is fixed at an upper end of the standing member 9. An opening 16' is provided at the head member 16. A roller 17 is pivotally supported by an upper surface wall at an outer side (base end side) than the opening 16'. The carbon thread K which is pulled out of the thread feeding hole 11 of the guide plate 10 attached at the outer side of the standing member 9 goes around an upper surface of the roller 17. A thread guide 17' is provided so that the carbon thread K does not get out of the roller 17 at the going-around time (refer to FIG. 4).

A slide body 18 capable of sliding vertically is provided at a lower side of the head member 16. In an illustrated example, the slide body 18 is attached to the standing member 9 between the intermediate member 12 and the head member 16 via a sliding part 18' so as to be smoothly slidable. There is a roller 19 pivotally supported by a vertical wall of the slide body 18, and the carbon thread K which went around the upper surface of the roller 17 at the base end side of the head member 16 goes around a lower surface of the roller 19 through the opening 16'. A thread guide 19' is provided so that the carbon thread K which goes around does not get out of the roller 19.

A disc 20 is rotatably provided in a horizontal direction at an upper surface at a tip end side of the head member 16. Besides, a vertical opening 20' is provided at a center part thereof. The disc 20 is pivotally supported so as to be able to lightly rotate via a bearing member 21, and a roller 22 is pivotally supported at an upper surface thereof. The carbon thread K which went around the lower surface of the roller 19 of the slide body 18 goes around an upper surface of the roller 22 through the vertical opening 20'. A thread guide 22' is provided at the roller 22 so that the going around carbon thread K does not get out. The carbon thread K which went around the upper surface of the roller 22 is fed to a knitting part (not-illustrated) of a torchon lace machine.

The carbon thread K which is fed to the knitting part of the torchon lace machine by going around the upper surface of the roller 22 is in a state in which a line K' from the carbon thread K went around the lower surface of the roller 19 of the slide body 18 until it enters the upper surface of the roller 22 which is pivotally supported by the disc 20 on the head member 16 is on a center line of the runner 4. It goes without saying that it may be in a vicinity of the center line. This is to enable to surely secure a path where a reed knife (not-illustrated) passes through when a wide product is effectively created by increasing the number of bobbins compared to a normal torchon lace machine. The carbon thread K is not thereby damaged at an operation time of the reed knife.

There is a case when pulleys whose cross sectional shapes are each V-shape are used for the rollers 17 and 22 at the base end side and the tip end side of the head member 16 and the roller 19 provided at the slide body 18 forming a U-shape with the rollers 17 and 22, to accurately lead the carbon thread, but they are not used in the thread feeding device 1 of the present invention. If the pulleys as stated above are used, a peripheral velocity difference is generated between inner/outer layers of the carbon thread and the inner layer is loosen. As a result, a single fiber is entangled in a groove part (V bottom) of the pulley, and there is a possibility that the thread is cut-off and fluffed. Accordingly, in the thread feeding device 1 of the present invention, a circular roller is used as each roller, in addition, the thread guides 17', 19' and 22' each made up of a metal thin bar are provided.

The roller 22 with thread guide provided at the tip end side of the head member 16 is fixed at the upper surface of the disc 20 which is rotatably provided in the horizontal direction to enable the roller 22 to constantly position correctly relative to the knitting part and enable the smooth feeding of thread even when the runner 4 moves toward right or left along the orbit 3 due to the rotation of the rotor metals.

The carbon thread K wound around the bobbin 7 is pulled out of the thread feeding hole 11 of the guide plate 10 attached at the outer side of the standing member 9, goes around the upper surface of the roller 17 pivotally supported at the base end part of the head member 16 and goes around the lower surface of the roller 19 pivotally supported at the slide body 18, and is fed to the knitting part from the roller 22 pivotally supported on the disc 20 rotatably provided in the horizontal direction at the upper surface at the tip end side of the head member 16. Namely, the carbon thread K is stored in the U-shape just before it is fed to the knitting part of the torchon lace machine, and the stored part is used at the knitting time. This is performed so that tissue is knitted smoothly without excessively tightening the carbon thread K.

A base end of a coil spring 24 provided at a void of the spindle 6 is coupled (fixed) to a stop ring 23 which is fitted to the lower part 6' of the spindle 6, and an upper end ring 15" of the wire 15 being extended from an upper end of the coil spring 24 is fitted and connected to a hook 18" provided at the slide body 18. The enlarged part 15' to push up the lower surface of the bobbin stopper 13 is provided in a middle of the wire 15.

When the stored part of the U-shaped carbon thread K is used at the knitting part of the torchon lace machine, the coil spring 24 is extended to oppose to a spring force and the roller 19 is moved upward, to make the U-shape small. The wire 15 connected to the slide body 18 is thereby pulled upward, and the enlarged part 15' in the middle thereof pushes up the lower surface of the bobbin stopper 13 to enable free rotation of the bobbin 7.

At the next moment, the coil spring 24 pulls the slide body 18 downward by the spring force, to make the U-shape of the carbon thread K large by the roller 19. At this time, the carbon thread K is pulled out of the bobbin 7 which is enabled to rotate freely. Movements to decrease and increase the U-shape size are also to keep tension of the carbon thread K connected to the knitting part constant when the bobbin 7 transfers the orbit 3 from inside to outside, or outside to inside due to the rotation of the rotor metals 2.

The wire 15 is connected to the slide body 18 via the upper end ring 15" and the base end of the coil spring 24 is coupled to the stop ring 23, to let the stop ring 23 fall down to cut-off an electrical system of the torchon lace machine when the carbon thread K wounded around the bobbin is exhausted or when it is cut-off by any reason.

The thread feeding device 1 of the present invention is to feed a carbon thread in which single fibers of carbon fibers are bound to a knitting part of a torchon lace machine under a state without any folding or cut-off of one piece of single fiber, and a knitted torchon lace cloth (not-illustrated) can be used as an industrial composite material.

INDUSTRIAL APPLICABILITY

The present invention enables to feed a carbon thread in which single fibers of carbon fibers are bound to a knitting part of a torchon lace machine under a state without any folding or cut-off of one piece of single fiber, and therefore, applicability thereof is high in the space industry field, the aviation industry field, the automobile industry field, and so on which utilize the industrial composite material using the carbon thread in addition to the torchon lace field.

The many features and advantages of the embodiment are apparent from the detailed specification and, thus, it is intended by the appended claims to cover all such features and advantages of the embodiment that fall within the true spirit and scope thereof. Further, since numerous modifications and changes will readily occur to those skilled in the art, it is not desired to limit the inventive embodiment to exact construction and operation illustrated and described, and accordingly all suitable modifications and equivalents may be resorted to, falling within the scope thereof.

REFERENCE SIGNS LIST

1 thread feeding device of the present invention
2 rotor metal

2' rotation axis
3 orbit
4 runner
5 spindle holder
5' flange part
6 spindle
6' lower part
6" upper part
7 bobbin
7' actiniform cog
8 frame member
8' screw
9 standing member
10 guide plate
11 thread feeding hole
12 intermediate member
13 bobbin stopper
13' pin
13" lower surface projection
14 spring
15 wire
15' enlarged part
15" upper end ring
16 head member
16' opening
17 roller
17' thread guide
18 slide body
18' sliding part
19 roller
19' thread guide
20' opening
20 disk
21 bearing
22 roller
22' thread guide
23 stop ring
K carbon thread

The invention claimed is:

1. A thread feeding device for a torchon lace machine, comprising:

a spindle which is provided to stand at a runner moving along an orbit due to rotation of rotor metals; and a standing member which includes a thread feeding hole to pull out a carbon thread wound around a bobbin rotatably inserted into the spindle and a bobbin stopper, wherein a U-shape is formed among rollers each with thread guide which are respectively provided at a base end side and a tip end side of a head member of the standing member and a roller with thread guide which is provided at a slide body provided to be vertically slidable at a lower part than the head member, to enable to feed the carbon thread to a knitting part, and the roller with thread guide which is provided at the tip end side of the head member is provided at an upper surface of a disc rotatably provided in a horizontal direction.

2. The thread feeding device for the torchon lace machine according to claim 1, wherein the slide body is tied up by a wire being extended from an upper end of a coil spring whose base end is coupled to a stop ring which is fitted to a lower part of the spindle and having a push-up part of the bobbin stopper in a middle thereof.

3. The thread feeding device for the torchon lace machine according to claim 1, wherein a line of the carbon thread entering the roller at the upper surface of the disc of the head member from the roller of the slide body is on a center line of the runner or in a vicinity thereof.

4. The thread feeding device for the torchon lace machine according to claim 2, wherein a line of the carbon thread entering the roller at the upper surface of the disc of the head member from the roller of the slide body is on a center line of the runner or in a vicinity thereof.

5. A thread feeding device for a torchon lace machine, comprising:

a spindle which is provided to stand at a runner moving along an orbit due to rotation of rotor metals; and a standing member which includes a thread feeding hole to pull out a carbon thread wound around a bobbin rotatably inserted into the spindle and a bobbin stopper, wherein a U-shape is formed among rollers each with thread guide which are respectively provided at a base end side and a tip end side of a head member of the standing member and a roller with thread guide which is provided at a slide body provided to be vertically slidable at a lower part than the head member, to enable to feed the carbon thread to a knitting part, and the slide body is tied up by a wire being extended from an upper end of a coil spring whose base end is coupled to a stop ring which is fitted to a lower part of the spindle and having a push-up part of the bobbin stopper in a middle thereof.

* * * * *